US005343113A

United States Patent [19]

Chang

[11] Patent Number: 5,343,113

[45] Date of Patent: Aug. 30, 1994

[54] CATHODE RAY TUBE APPARATUS WITH REDUCED BEAM SPOT SIZE

[76] Inventor: Kern K. N. Chang, 91 Adams Dr., Princeton, N.J. 08540

[21] Appl. No.: 937,227

[22] Filed: Aug. 28, 1992

[51] Int. Cl.[5] ..... H01J 29/48; H01J 29/58

[52] U.S. Cl. ..... 313/414; 313/453; 315/15

[58] Field of Search ..... 313/412, 414, 431, 432, 313/433, 440, 453; 315/15, 16, 382

[56] References Cited

U.S. PATENT DOCUMENTS 3,740,607 6/1973 Silzars et al. .
3,980,919 9/1976 Bates et al. .
4,429,254 1/1984 Chang .
4,742,266 5/1988 New .

OTHER PUBLICATIONS

Advances in CRT Technology, Watkins-Johnson Company, Tech-notes, vol. 6, No. 2 by Norman Lehrer Mar./Apr., 1979 pp. 1-11.

The Laminar Flow Gun CRT, Watkins-Johnson Company, Tech-notes, vol. 1, No. 3 May/Jun., 1974 pp. 1-10.

An Experimental "In-Neck" integrated Yoke, SID 84 Digest, K. K. N. Chang, RCA Laboratories, 1984, pp. 264-267.

Cathode-Ray Tubes, Radiation Laboratory Series, McGraw-Hill, New York, vol. 22, 1948, p. 47.

*Primary Examiner*—Sandra L. O'Shea
*Attorney, Agent, or Firm*—Plevy & Associates

[57] ABSTRACT

There is disclosed a cathode-ray tube which employs an electron gun assembly of the laminar flow (LF) type. The beam emanating from the LF electron gun assembly is directed through a three-electrode einzel lens assembly where the center electrode of the einzel lens assembly is subjected to a modulation voltage. Positioned after the einzel lens assembly are magnetic deflection circuits which include a horizontal and vertical coil enabling the beam to deflect in the horizontal and vertical directions and which circuits are positioned internally within the CRT. A convergence assembly is also built within the neck of the CRT. Thus, the CRT provides the advantages of the laminar flow gun while enabling modulation of the electron beam to provide an extremely small spot size to enable the CRT to operate with small spot size and to provide more efficient deflection at higher modulation rates.

20 Claims, 3 Drawing Sheets

CATHODE RAY TUBE APPARATUS WITH REDUCED BEAM SPOT SIZE

FIELD OF THE INVENTION

This invention relates to an improved cathode-ray tube (CRT) and more particularly, to an improved cathode-ray tube (CRT) which employs deflection yokes located within the neck of the CRT, and which is capable of producing a reduced beam spot size.

As one can ascertain, the cathode-ray tube (CRT) is the dominant electronic display device for high resolution applications. The CRT is widely employed in the field of television and for example, in the color television receiver. The CRT assumes various configurations and has had various improvements made to the original structure. For color television operation, there is the famous shadow mask CRT which configuration is widely employed.

Various other CRT's have phosphor arrangements which define the red, green and blue phosphors in different manners then the shadow mask CRT, such as the Trinitron, as well as various penetration type CRT's. In any event, the endurance and the dominance of the CRT is due to its continuing technical and economic superiority. As one will understand, the major disadvantages of CRT's is their effective size, depth and so on. Thus, the prior art has proposed various flat-panel CRT's and so on in order to improve the device and to avoid some of the disadvantages.

In present technology, the CRT while improved, has basically remained very similar to those CRT's which have been provided over decades. Improvements made to the CRT operate to extend tube life, and provide better phosphors and brighter displays and so on. In any event, a major problem with modern day CRT's is the effective spot size which in many modern state of the art CRT's is minimumly approximately 0.5 mm. Modern technology is concerned with high definition television (HDTV). The HDTV or enhanced definition television (EDTV) is absolutely going to be implemented in the future. Presently, various different systems have been proposed and essentially any proposed system must tentatively use only the TV spectrum which is now allocated and existing NTSC (in the U.S.A.) services for the foreseeable future. Thus, there should be no disruptive change in the delivery or reception of the conventional television signals while development of the new HDTV systems continue.

Proposed HDTV systems are specified to employ 1125 lines per frame with 1035 active lines per frame. The system use a 2:1 interlace with a 16:9 aspect ratio, with 609 Hz fields per second and at a 33.750 kHz line frequency. Certain standards have also been set for the chromaticity coordinances for RGB primary colors and so on. The proposed systems will provide high display definition as compared to the definition presently available with the conventional NTSC system. Another important aspect in achieving high definition, is again reducing the CRT spot size. A reduction in spot size and the maintenance of the brightness and intensity, will achieve increased resolution. It is apparent that the maximum resolution provided by a CRT is a function of the spot size. The smaller the spot size, the greater the resolution of the CRT. While it is known that the CRT is a high resolution display device, it is indicated that the resolution has to be even greater for optimum HDTV systems.

As indicated above, there have been many advances made to the CRT over the past decades. A particular impressive advance was the introduction of the laminar flow (LF) electron gun. Cathode-ray tubes employing the laminar flow gun basically exhibit a clearer, brighter display because of improvements in resolution and reduced grid drive requirements. See for example, U.S. Pat. No. 3,740,607, entitled LAMINAR FLOW ELECTRON GUN AND METHOD, issued to A. Silzars and D. J. Bates. The so called laminar flow gun has also been described in a publication by Watkins-Johnson Company, designated Tech-notes, Vol. 6, No. 2 March/April 1979, entitled ADVANCES IN CRT TECHNOLOGY. The article basically describes the crossover electron gun (COG) which has been the primary electron gun employed since the commercial development of the CRT. The article then describes the laminar flow gun which basically is physically and electrically interchangeable with the crossover counterpart.

In the crossover gun, the electrons are converged to a crossover which is imaged on the viewing screen. In the case of the laminar flow gun, the electrons emitted from the cathode tend to flow in streamline paths until they are converged to a focus at the viewing screen. The operation of both guns are extremely well known. In any event, as the prior art understands, modern CRT's have a minimum optimum spot width which is approximately 0.5 mm. The function of the electron guns is to produce a small intense spot of controlled brightness on a phosphor viewing screen. The term brightness is used to denote luminance which is the luminance flux per unit area of the emitting surface measured in lumens per square foot. Thus, in order to produce the brightest display, the electron gun must produce the largest current density in the smallest possible area. As is well known, the crossover CRT provides an intense source by shaping the electric field lines in a triode region so that the emitted electrons converge to a crossover almost immediately upon leaving the cathode. In the laminar flow CRT, electrons emitted from the cathode tend to flow in streamline paths until they converge to a focus at the viewing screen.

Because of the shape of the electric field lines, the current density across the cathode is relatively constant and may be considered to be cylindrical in shape for a circular cathode. In any event, apart from spot size as effecting resolution, it is also known that deflection and focus, as well as the type of deflection and focus employed in a CRT also effects resolution. For example, electrostatic deflection employs deflection plates set at right angles to each other which provide horizontal and vertical deflection. The deflection amplitude obtained by electrostatic deflection is inversely proportional to the screen potential. Electrostatic deflection provides the highest deflection speeds available but with moderate resolution. It is normally used in combination with electrostatic focus. Magnetic deflection provides slower deflection speeds and exhibits moderate resolution when used with electrostatic focus. This combination is the most widely used. Magnetically deflected and magnetically focused tubes provide the highest resolution.

Thus, resolution based on deflection is also known in the prior art and further details are given in the above-noted technical article. In any event, a substantial problem in regard to the laminar flow CRT is that laminar flow gun cannot be utilized at high modulation rates. Furthermore, if the spot size is made smaller then one may have a problem in regard to the deflection techniques. The systems should provide adequate and optimum deflection to maintain good resolution when using an extremely small spot size. It has been known that placing the deflection yoke of a CRT inside the glass envelope of the CRT, permits a reduction in deflection power with an increased deflection sensitivity. Since the deflection fields may be localized close to the electron beams, the yoke can be made much smaller resulting in a significant materials and cost savings. As the prior art was aware of, placing the deflection yoke inside the glass envelope, is subject to certain problems. The insulation of conventional enamel deflection coil wire does not withstand the high tube baking temperatures encountered in the tube manufacturing process. Thus, the prior art was cognizant of these and other problems, and such problems were circumvented by the prior art.

Reference is made to U.S. Pat. No. 4,429,254, entitled DEFLECTION YOKE INTEGRATED WITHIN A CATHODE RAY TUBE, issued on Jan. 31, 1984 to Kern K. N. Chang, the inventor herein and assigned to the RCA Corporation. That patent discloses an electron beam deflection yoke located within the glass envelope of a cathode-ray tube to increase deflection sensitivity and decrease deflection power consumption. The yoke comprises a plurality of elongated core members with pole pieces formed at one end. The horizontal and vertical deflection coils are wound on the elongated core members and are energized to produce deflection fields. Deflection field return flux in the core causes fields to be formed between the pole pieces. Magnetically permeable shielding means interact with the fields, produced by the coils, to shield the electron beam from the deflection fields outside the region occupied by the pole pieces, resulting in a shorter deflection region which allows wider beam deflection angles. Thus, as one ascertain, this arrangement of the CRT with integrated deflection yokes results in improved operation.

It is an objective of the present invention to provide a improved cathode-ray tube which employs an internal deflection and modulation structure and which tube further incorporates a laminar flow electron gun. As will be described, the tube includes an einzel lens assembly with a central electrode which is located in the drift region of the tube, to enable modulation to be applied to the electron beam from a parallel or laminar flow gun structure.

In this manner, the laminar flow CRT employs an internal yoke and is capable of providing a spot size which is significantly smaller then presently available spot sizes. The tube requires less deflection voltages and can operate in an extremely reliable manner having all the advantages of a laminar or parallel flow gun while producing an extremely small spot size (0.3 mm). The tube can be modulated at rapid rates making it completely suitable for HDTV applications.

SUMMARY OF THE INVENTION

A cathode-ray tube apparatus comprising a glass envelope and a laminar flow electron gun disposed in said glass envelope for producing a parallel electron beam. Deflection means disposed within said glass envelope for deflecting said beam in the X & Y directions. An einzel lens assembly disposed in said glass envelope and positioned between said gun and said deflection means. Said einzel lens assembly having a first electrode assembly located near said gun, a central electrode and a second electrode located near said deflection means, with said first and second electrodes adapted to receive a DC biasing potential and with said central electrode adapted to receive a modulating potential for modulating said parallel electron beam without significantly changing the effective beam spot size.

DETAILED DESCRIPTION OF THE FIGURES

Figure 1:
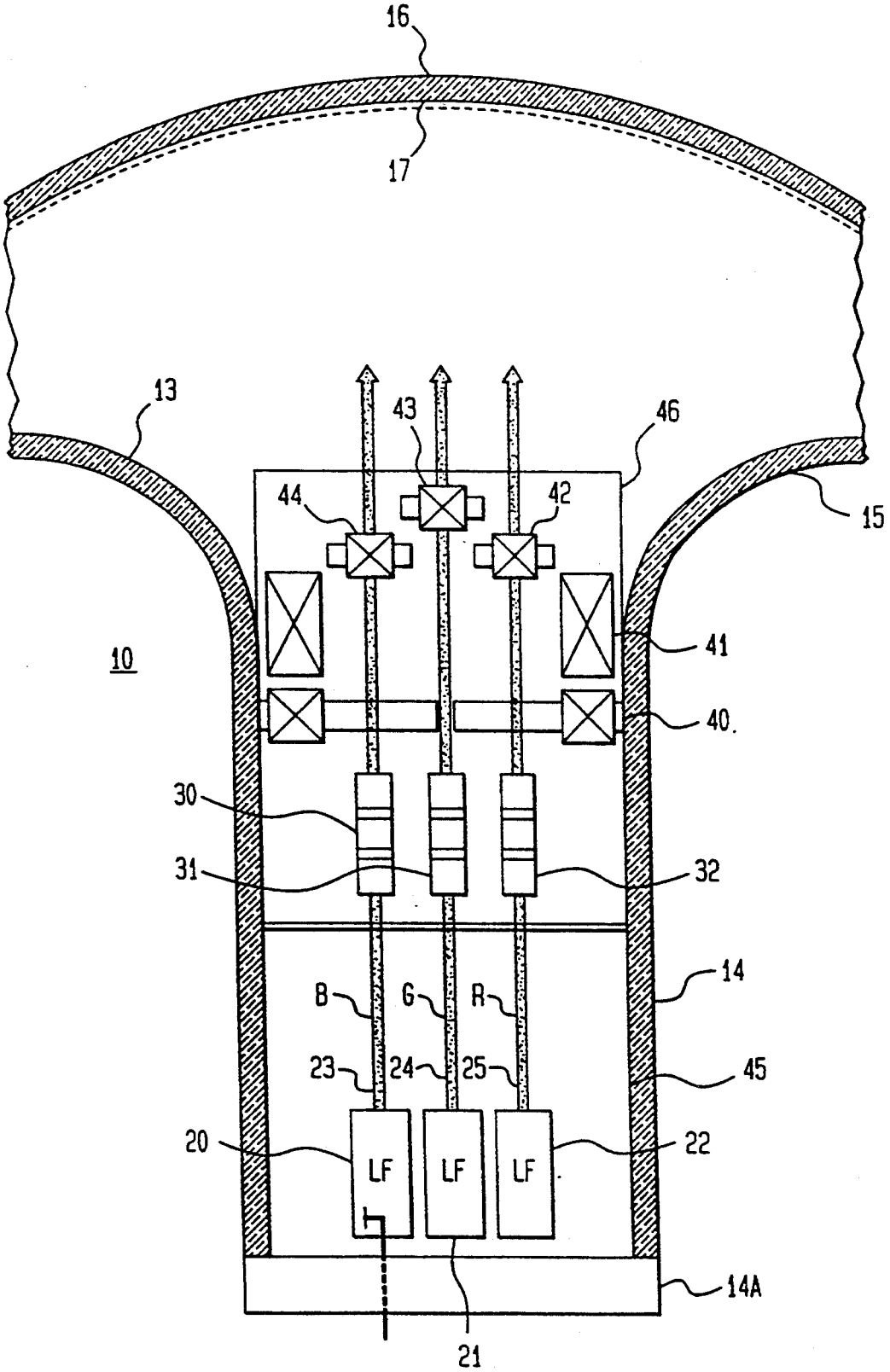
FIG. 1 is a cross-sectional view of a television display system, partially in segmented form, incorporating a cathode-ray tube in accordance with this invention.

Referring to FIG. 1, there is shown a television display system comprising a kinescope 10, which includes a sealed glass envelope 13. The sealed glass envelope 13 essentially consists of a elongated cylindrical neck portion 14, which is joined to a flared funnel portion 15 which eventually is joined to a face plate 16. The face plate 16 which is the display screen of the CRT, has superimposed on an opposite face a suitable phosphor layer enabling the CRT to operate as a color CRT employing either a shadow mask or penetration phosphor arrangement. While a color CRT is, of course, preferred the arrangement can be used for a black and white CRT or unicolor CRT by using a single gun and so on.

The shadow mask tube, as well as penetration kinescopes, are well known in the art. In any event, a typical CRT employs an electron gun assembly which is disposed in the neck portion 14 of the CRT 10 or three electron guns for a color CRT designated 20, 21 and 22. Each of the electron guns is indicative of a primary color. As for example, electron gun 20 produces a beam 23 which is the blue beam (B), electron gun 21 produces a beam 24 which is the green beam (G), while electron gun 22 produces a beam 25 which is the red beam (R). Each of the guns is designated by the numerals LF which stands for laminar flow or parallel flow. As indicated above, a laminar flow electron gun is well known and basically is an extremely reliable device. Laminar flow guns have been used in CRT's for many years. In the laminar flow guns, electrons which are emitted from the cathode of the laminar flow CRT, tend to flow in streamline paths until they converge to a focus at the viewing screen 16 or at surface 17 containing the phosphor.

Because of the shape of the electric field lines, the current density across the cathode is relatively constant and may be considered to be cylindrical in shape for a circular cathode. For the same peak cathode loading in the ideal case, the laminar gun provides three times the current density from the same cathode area, since the volume of the cylinder is three times the volume of a cone. The laminar flow gun CRT is compared to the crossover CRT which essentially provides a source by shaping the electric field lines in a triode region so that the emitted electrons converge to a crossover almost immediately upon leaving the cathode. This is the reason that the gun is called the crossover gun.

In any event, the laminar flow gun such as guns 20, 21 and 22, can produce the same total current using only 60 percent of the crossover gun cathode diameter thereby reducing the diameter of the emitting region by 40 percent. Thus, for a given beam current and an emitted diameter, the peak cathode loading is considerably less using the laminar flow gun. Thus, the operation of the laminar flow gun, in comparison for example, with the crossover gun (COG) is well known and has been documented. See for example an article entitled THE LAMINAR FLOW GUN CRT, published by Watkins-Johnson Company in Tech-notes, Vol. 1, No. 3, May/June 1974. This technical note discusses the advantages of the laminar flow gun as compared to the prior art crossover gun.

In any event, as seen in FIG. 1, the guns for providing the blue, green and red beams 23, 24 and 25 are laminar flow guns 20, 21 and 22. The major problem with the laminar flow gun is that it cannot be modulated in a convenient manner. In this manner, as the beams of the laminar flow gun are modulated, the spot size changes drastically and increases in diameter and changes shape and therefore the resolution goes down as a function of modulation. This is totally undesirable. While the laminar flow gun is capable of providing an extremely small spot, the spot becomes defocused and deformed during modulation. This is suitable for present day CRT's utilizing conventional scanning rates and low resolution.

In any event, for HDTV applications, a laminar flow CRT would not be acceptable. Each of the laminar flow guns 20, 21 and 22 is associated with an einzel lens electrode assembly which as will be explained consists of a central electrode which is bounded on each side by peripheral electrodes. The einzel lens central electrode has a modulating voltage applied to enable one to modulate the electron beams 23, 24 and 25 in such a manner as to not change the effective spot size. The einzel lens assembly focuses the beams prior to the deflection of the same and within the drift region of the beam path. The deflection of the beams is accommodated by internal deflection yokes and internal convergence yokes.

Thus, as seen in FIG. 1, there is shown the following components. Reference numeral 40 refers to the horizontal deflection convergence control which essentially as will be explained, is a series of windings wound about and formed about insulation sheath. There is shown the horizontal deflection yoke 41 and the vertical deflection yoke 42. As seen, each of the electron beams 23, 24, and 25 has an associated einzel lens assembly as 30, 31 and 32. Each of the beams, 23, 24, and 25 is associated with its own vertical deflection yoke as 42, 43 and 44. The horizontal deflection yoke 41 is common to all of the beams as is the horizontal deflection convergence control.

The utilization of internal deflection yokes is known and has been described in the above-noted U.S. Pat. No. 4,429,254. See also an article by the inventor herein entitled AN EXPERIMENTAL "IN-NECK" INTEGRATED YOKE, by K. K. N. Chang, RCA Laboratories, Princeton, N.J. published in the SID 84 Digest, pages 264–267. There is described an integrated beam deflection system formed within a 19 inch CRT neck. The CRT shows improved spot sizes with relatively fixed deflection centers over those established with external yokes. Order of magnitude savings are realized in material and energy consumption. In any event, the kinescope 10 of FIG. 1 also employ a similar beam deflection system which is formed within the neck of the kinescope 10. This is done in accordance with the teaching of the above-noted patent or the article as described.

Figure 2:
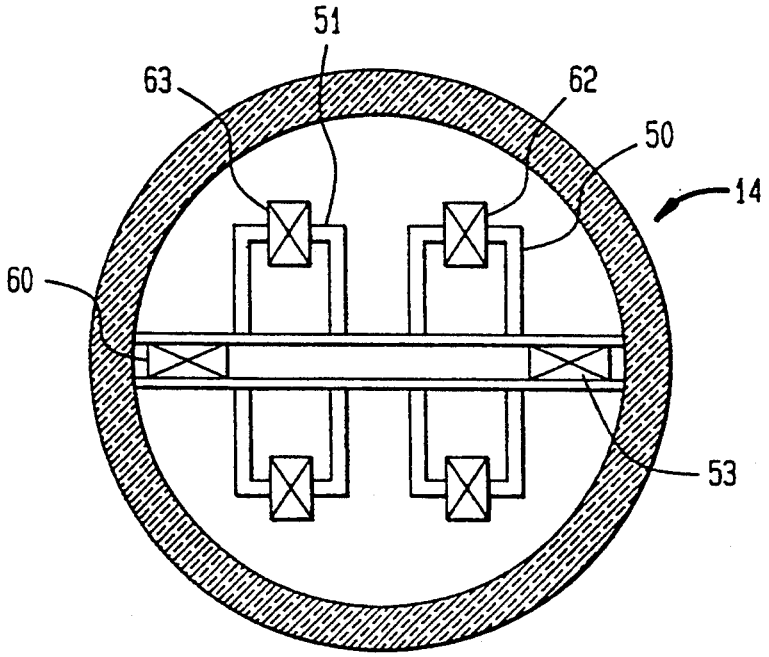
FIG. 2 is a cross-sectional view taken through the neck portion of the CRT of FIG. 1.

Essentially the deflection yoke as 41 and 42 for both the vertical and horizontal circuits may include a magnetically permeable core-shaped structure as shown in FIG. 2. The core-shaped structures may be of the configuration depicted in the '254 patent and may have a ring-shaped base with four or more elongated rod-shaped members for the horizontal deflection. The elongated members may extend parallel to the longitudinal axis of the neck portion of the tube and may be manufactured by many different ways. Each of these members may have a flux directing member or pole piece which are conventionally supported.

Vertical deflection coils can be wound about the elongated members and the horizontal deflection coils are wounded about additional members. This can be accommodated for each of the electron guns. Therefore, it is well known how to provide both horizontal deflection and vertical deflection coils within the neck of a kinescope as shown in FIG. 1 and FIG. 2. It is also known how to manufacture such devices including the materials utilized for such devices. FIG. 2 shows the cores 50 and 51, as well as the insulation sheath 53. The horizontal coils 60 are wound about the longitudinal members with the vertical coils as 62, 63 appropriately positioned for each of the guns.

As seen, in FIG. 2, the coil, 62 and 63 are the vertical coils for the red and blue beams as 23 and 25 of FIG. 1. The vertical coil 43 for the green beam is not shown in the figure. The horizontal coil 60 is shown appropriately wound and in schematic form. In any event, the utilization of coil structures within the neck of the CRT are known, and operation of such coil structures is also well known. It is understood that the utilization of deflection yokes, both for the horizontal and vertical circuits that are integrated within the electron gun and mounted inside the vacuum glass envelope, provides improved resolution and significant savings in cost and energy consumption.

While FIG. 1 depicts an electron gun assembly for providing three beams it is understood that an electron gun assembly producing a single electron beam for use in a black and white or single color kinescope is also contemplated to be within the scope of the present invention. In any event, by locating the deflection yoke inside the tube, one can achieve a reduction in deflection power with increased deflection sensitivity since the deflection fields may be localized close to the beams. The yoke can be small resulting in significant materials and cost savings. This gives a further improvement in resolution.

In any event, by using a parallel or laminar flow gun, one achieves the advantages inherent with such guns. A major aspect of the present invention is the presence of the three einzel lens assembly 30, 31 and 32 each associated with a separate electron beam and each capable of achieving modulation of the beam in a rapid and reliable manner, thereby improving the total operation of the kinescope 10 as compared to prior art kinescopes. Basically, the einzel lens is well known and has been employed in many cathode-ray tubes to provide electrostatic focus. An einzel focusing lens was depicted in the text entitled CATHODE-RAY TUBES, Radiation Laboratory Series, Vol. 22, page 47, McGraw Hill, New York, 1948.

The einzel lens consists of a set of three electrodes and by proper design the focal condition can be made to occur when the voltage on the central element is zero or at a small positive voltage with reference to the cathode. The einzel lens configuration consists of a first electrode commonly referred to an accelerator electrode, a first anode and a second anode. In this manner, the einzel lens has a configuration as depicted in FIG. 3.

Figure 3:
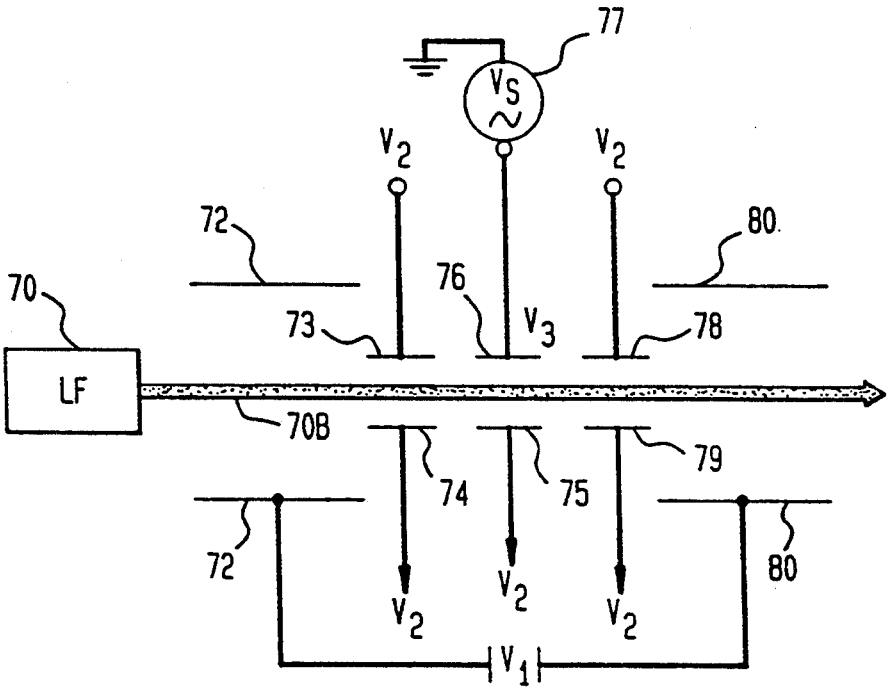
FIG. 3 is a schematic assembly of an electric electron beam deflection circuit, employing an electric einzel lens.

Referring to FIG. 3, there is shown a laminar flow gun 70 which may be one of the guns as 20, 21 and 22 of Fig, 1. In any event, the gun 70 produces a beam of electrons 70B. The beam of electrons 70B traverses through the einzel lens assembly consisting of electrodes or plates 73, 76 and 78. The plates or electrodes 73, 76 and 78 may be cylindrical electrodes or may include a top and bottom plate pair as 73 and 74, 75 and 76 and 78 and 79 which will operate to deflect the beam in the vertical direction as shown in FIG. 3. In any event, the plates could be cylindrical.

In a similar manner, there is an input ring 72 and an output ring 80. The rings 72 and 80 are the anode electrode cylindrical rings as shown in FIG. 1 as rings 45 and 46. Essentially, the electrodes as 72 and 80 are cylindrical rings both of which have the voltage $V_1$ impressed thereon. The voltage $V_1$ is a DC voltage.

A modulating potential via modulating source 77, is applied to the central electrode consisting of plates 75 and 76 or a central ring. This potential is designated as $V_s$. The plates or rings 73 and 78 have the potential $V_2$ imposed thereon. The voltage on the ring 72 and 80 which is voltage $V_1$ is much greater then the voltage $V_2$ which is the voltage on plates or rings 73 and 78 which is greater then the voltage $V_3$ which is on the center plate or ring and is the DC component superimposed on the modulating voltage $V_s$. As an example, the voltage $V_1$ may be 25,000 volts or 25 kv, voltage $V_2$ may be about 500 volts while voltage $V_3$ may be 200 volts. In this manner, a modulating voltage $V_s$, via modulating source 77, is applied to the center electrode of the einzel lens. The modulating voltage $V_s$ applied to the center electrode controls the position of the beam while the electrodes 78, 79 and 80 serve to focus the beam. In this manner, the beam can be modulated or moved in a rapid manner without the loss of focusing. FIG. 3 shows a typical electric modulation scheme employing the einzel lens assembly which may employ plates or circular rings to produce the control and focusing of the beam.

Figure 4:
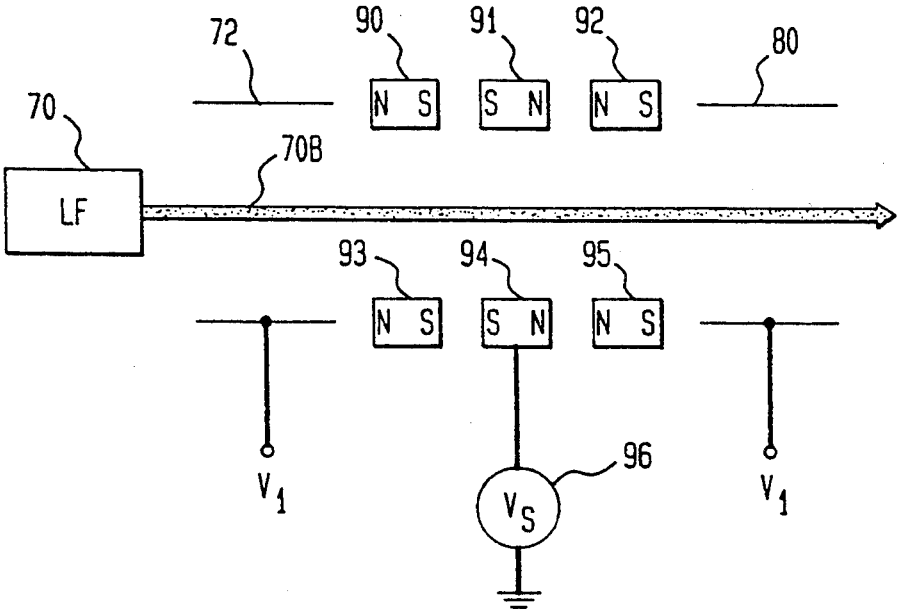
FIG. 4 is a schematic, depicting a magnetic einzel lens assembly where the center electrode is biased by a modulation signal.

Referring to FIG. 4, wherein like numerals refers to like elements, there is shown a magnetic circuit which provides a magnetic einzel lens assembly. As seen in FIG. 4, there is again a laminar flow gun 70 which can be any of the electron guns as 20, 21 and 22 of FIG. 1. The gun 70 produces a beam of electrons 70B. The beam 70B is again directed through a biased concentric cylindrical conducting ring 72 which has a voltage of $V_1$ impressed thereon. A similar output ring 80 also has the voltage $V_1$ impressed thereon.

As shown, the einzel lens in the configuration depicted in FIG. 4, consists of magnetic structures 90, 91, 92, 93, 94 and 95. The magnetic structures 90 and 92 both have the north poles located on the right side with the south poles on the left while the central magnetic structures 91 and 94 has the south pole on the right and the north pole on the left. The central magnetic structure consisting of magnets 91 and 94 has a modulating voltage or current source 96 coupled thereto.

Figure 5:
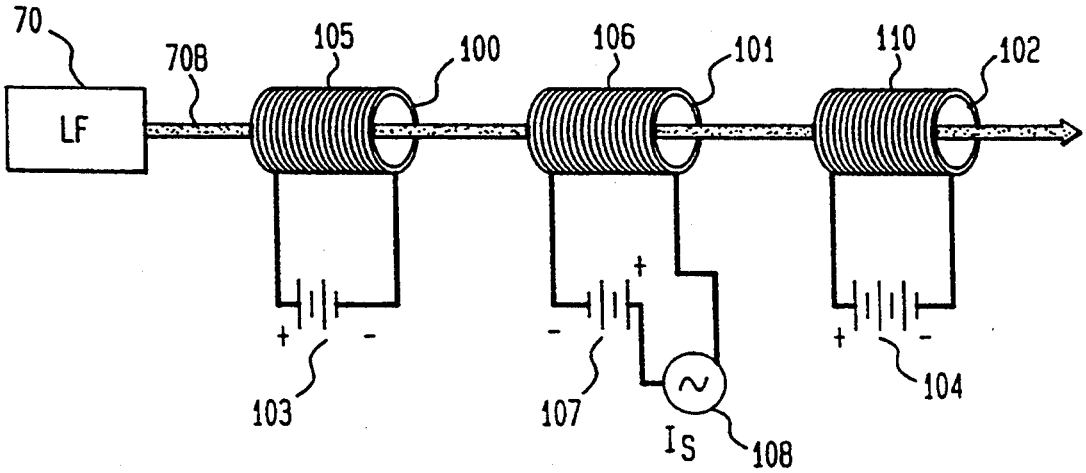
FIG. 5 is a schematic diagram, depicting a circuit arrangement for implementing the magnetic circuit depicted in FIG. 4.

Referring to FIG. 5, there is shown the physical structure of the magnetic structure of FIG. 4. Thus the laminar flow electron gun 70 emits the electron beam 70B which is directed through the central apertures of magnetic structures or ferrite cylindrical structures 100, 101 and 102. Each of the structures is biased by a suitable potential via a as battery 103 for core 100 and battery 104 for core 102. The batteries are coupled to suitable windings wound about the cores such as windings 105 and 110 to create an electromagnet with the north and the south pole as indicated in FIG. 4. The center magnetic core 101 is surrounded by a winding 106 which is directed to a battery 107 to give the biasing voltage for producing a south and a north pole. The winding 106 is in series with the current source 108 to provide the modulation for the center electrode of the magnetic einzel lens configuration.

Thus, as one can ascertain, an improved kinescope capable of extremely small spot dimensions and using high efficiency deflection and convergence circuitry provides a small spot beam utilizing a laminar flow gun. The laminar flow gun enables reduced spot size but as indicated, is subjected to defocusing when modulated. In this manner, the kinescope includes einzel lens assemblies, each of which is operated and associated with a separate one of the three beams in a color kinescope and each of which has the center electrode applied to a source of modulating voltage, to thereby modulate the respective beams from the laminar flow gun without reducing or effectively disturbing spot size and maintaining exact focus.

In this manner, one can provide a kinescope which is suitable for HDTV operation by providing high resolution at extremely fast rates. In summation, the state of the art employed the crossover gun which is the most widely used gun for CRT's. It is of course understood, that the state of the art also provided laminar flow or LF guns, but these guns are not capable of good modulation. In a typical state of the art crossover gun the spot size is 0.5 mm at 5 percent. The modulation is performed by cathode or first grid modulation which is in the beam forming region of the cathode-ray tube and is normally provided by electrostatic or electric modulation by varying the voltage on a cathode or the grid. The deflection or scanning of the crossover gun is provided by an external yoke and external scanning components. The color registration is usually by the shadow mask or the Trinitron technique. Convergence is externally controlled via a single external yoke and is for three beam convergence.

In the above-described improved HDTV CRT, one uses the parallel flow gun or a laminar flow gun where one can achieve a spot size of 0.3 mm at 5 percent. The CRT employs an einzel lens assemblies located in the drift region of the cathode-ray tube. Modulation of the beam is implemented by varying the voltage on the center electrode of the einzel lens assembly. The einzel lens assemblies can be electric or magnetic. Deflection or scanning is provided by internal yokes which are built into the neck of the tube. Color registration again can be shadow mask or a penetration phosphor and convergence is independently controlled via three independent internal yokes.

The CRT 10 of FIG. 1, is shown without a stem. In any event, as is known, the end of the neck portion 14A of FIG. 1 is terminated in a plug with extending pins for each of the above-described circuits. Then there would be 9 pins to accommodate each of the 9 electrodes of the einzel lens, elements 30, 31 and 32. There would be separate electrodes for the horizontal and vertical deflection circuits and convergence circuits and so on. The fabrication of such pins and plugs is well known.

I claim:

1. A cathode-ray tube apparatus, comprising:

a glass envelope and a laminar flow electron gun disposed in said glass envelope for producing a parallel electron beam, deflection means disposed within said glass envelope for deflecting said beam in the X and Y directions, an einzel lens assembly disposed in said glass envelope and positioned between said gun and said deflections means, said einzel lens assembly having a first electrode assembly located near said gun, a central electrode and a second electrode located near said deflections means, with said first and second electrodes adapted to receive a DC biasing potential and with said central electrode adapted to receive a modulating potential for modulating said parallel electron beam without significantly changing the effective beam spot size.

2. The CRT apparatus according to claim 1, wherein said einzel lens assembly is an electric einzel lens.

3. The CRT apparatus according to claim 1, wherein said einzel lens assembly is a magnetic einzel lens assembly.

4. The CRT apparatus according to claim 1, wherein said glass envelope has a screen area for viewing with a color phosphor arrangement disposed within said envelope to coat said screen, three electron guns disposed within said glass envelope for providing three parallel beams one for each primary color Red, Green and Blue (RGB), three separate vertical deflection yokes disposed within said glass envelope one for each beam, and three separate einzel lens assemblies disposed within said glass envelope, one for each beam.

5. The CRT apparatus according to claim 4, wherein said color phosphor arrangement is of the shadow mask configuration.

6. The CRT apparatus according to claim 4, wherein said color phosphor arrangement is of the penetration configuration.

7. The CRT apparatus according to claim 1, wherein said first and second electrode assemblies of said einzel lens assembly are biased at a voltage $V_2$.

8. The CRT apparatus according to claim 7, further comprising a first anode ring electrode assembly located within said glass envelope and positioned before said first electrode assembly of said einzel lens assembly and adapted to receive a potential much greater than $V_2$, and a second anode ring electrode assembly located within said glass envelope and positioned after said second electrode of said einzel lens assembly adapted to receive said higher potential.

9. The CRT apparatus according to claim 1, further including;

convergence control means disposed in said glass envelope and operative to converge said electron beam.

10. A cathode-ray tube (CRT) apparatus contained in a glass envelope having a neck portion and a screen portion, said screen portion of said CRT containing RGB phosphors to enable said CRT to provide a color image for viewing at said screen, comprising:

a laminar flow electron gun means disposed in said neck portion of said envelope for providing three parallel electron beams, one for each phosphor (RGB), biasing means disposed in the said neck portion and adapted to receive a biasing potential to control said beams as emitted by said gun means, first, second and third einzel lens assemblies, each having three electrodes and each associated with one of said beams to focus said beam via an input and output electrode and to modulate said beam via a central electrode, vertical deflection means disposed in said envelope for vertically deflecting each of said beams and horizontal deflection means disposed in said envelope for horizontally deflecting said beams.

11. The apparatus according to claim 10, wherein said einzel lens assemblies are electric einzel lens assemblies.

12. The apparatus according to claim 10 wherein said einzel lens assemblies are magnetic einzel lens assemblies.

13. The apparatus according to claim 10, further including:

convergence control means located within said envelope for converging said beams at said screen.

14. The apparatus according to claim 10, wherein said biasing means includes a first conductive ring positioned between said gun means and said input electrode of said einzel lens assemblies and a second conductive ring at the output of said einzel lens assemblies, said first and second rings adapted to receive a DC operating potential of a magnitude much greater than any DC potential applied to said einzel lens assemblies.

15. The CRT apparatus according to claim 10, having electron beam spot size of less than 0.5 mm at 5 percent modulation.

16. The CRT apparatus according to claim 10, wherein said einzel lens assemblies are positioned in the drift region of said beams.

17. The CRT apparatus according to claim 10, wherein said first and second electrodes of each einzel lens assemblies are adapted to receive a first DC biasing potential.

18. The CRT apparatus according to claim 17, wherein said first and second rings are adapted to receive a DC biasing potential of a magnitude much greater than said first DC biasing potential.

19. The CRT apparatus according to claim 18, wherein said first DC biasing potential is about 500 volts, with said ring DC potential being about 25,000 volts.

20. The CRT apparatus according to claim 10, wherein each of said einzel lens assemblies include first, second and third cylindrical cores in series and having coaxial centrally aligned apertures for enabling an electron beam to pass through from said first to said third core, via said second core each core fabricated from a magnetic material and having wire windings wound about the outer surface for connecting each winding of the first and third cores to a source of DC potential to provide a magnet having a north pole at the input of said core and a south pole at an output, with the winding of said center core connected to a DC potential to provide a south pole at the input and a north pole at the output and a modulation source connected to said center core to modulate said beam.

* * * * *